United States Patent [19]

Massino

[11] Patent Number: 4,542,902

[45] Date of Patent: Sep. 24, 1985

[54] SOCCER BALL AND METHOD OF MAKING SAME

[75] Inventor: Chester F. Massino, Sandwich, Ill.

[73] Assignee: Ideas That Sell, Inc., Sheridan, Ill.

[21] Appl. No.: 589,759

[22] Filed: Mar. 15, 1984

[51] Int. Cl.[4] ..... A63B 41/08

[52] U.S. Cl. ..... 273/65 A; 273/65 EB; 273/65 ED; 273/DIG. 20

[58] Field of Search ..... 273/58 A, 58 R, 58 K, 273/DIG. 20, 428, 411, 65 R, 65 E, 65 EB, 65 EC, 65 ED

[56] References Cited

U.S. PATENT DOCUMENTS

| | | | |
|---|---|---|---|
| 2,213,013 | 8/1940 | Owen | 273/199 R |
| 3,927,882 | 12/1975 | Galarza | 273/58 A X |
| 4,169,594 | 10/1979 | Crane | 273/58 BA |
| 4,239,568 | 12/1980 | Takazawa | 273/58 BA X |
| 4,257,598 | 3/1981 | Massino | 273/DIG. 20 X |
| 4,261,565 | 4/1981 | Massino | 273/DIG. 20 |
| 4,284,398 | 8/1981 | Bokelmann | 273/58 R |
| 4,337,944 | 7/1982 | Massino | 273/DIG. 20 |
| 4,354,679 | 10/1982 | Steinmetz | 273/58 A |
| 4,463,951 | 8/1984 | Kumasaka | 273/58 A |

*Primary Examiner*—George J. Marlo

*Attorney, Agent, or Firm*—Leydig, Voit & Mayer

[57] ABSTRACT

Soccer balls comprised of (1) a generally spherically shaped center portion or core prepared from a piece(s) of material, such as cotton batting, (2) multistrand yarn at least partially covering this center portion, (3) tape at least partially covering the yarn covered center portion, (4) a synthetic cloth cover (preferably a doubleknit polyester). The cover is preferably formed of two cloth pieces which have patterns imprinted thereon by, e.g., silk screening, designed so that, when the cover is secured over the wrapped center portion, the ball has the appearance of a conventional soccer ball. The balls of this invention have substantially the same size, shape and performance characteristics (particularly the aerodynamic characteristics) of the balls they are meant to replace, i.e., soccer balls, when thrown or kicked, but are softer and lighter and have lower coefficients of elastic restitution, allowing for their use in congested areas—they do not travel as far when kicked—and by young children who are more susceptible to injury with hard balls or handicapped persons who are similarly susceptible to injury and who may have special difficulty with hand-eye coordination.

19 Claims, 8 Drawing Figures

SOCCER BALL AND METHOD OF MAKING SAME

TECHNICAL FIELD

This invention relates to soccer balls, more particularly to balls which can be substituted for conventional soccer balls, and to the method of producing them.

BACKGROUND ART

The sporting goods industry strives to improve the equipment available for each sport and soccer is no exception. There are a number of problems associated with conventional soccer balls due to their structure. First, they are not well suited for indoor use since they can readily break windows and other fragile items. Additionally, conventional soccer balls require a considerable amount of space in order to play since the balls can travel long distances. Further, it is difficult for a beginner to attain and maintain control over the ball, particularly when kicked or thrown toward him at high velocity. It is also difficult for a beginning goalkeeper to catch and hold onto a ball when kicked at him.

Conventional soccer balls can also cause pain and/or injury when they strike the face or other sensitive parts of the body. The potential for this is particularly high for goalkeepers. The chances for such an injury and the attendant pain are increased in cold weather. The likelihood of such an occurrence is also higher for young children who have not yet developed good hand-eye coordination.

An additional problem with conventional soccer balls is that they are inflated with air and once the bladder has been punctured, the ball is essentially useless.

Accordingly, it is an object of this invention to minimize the problems noted above while maintaining as many of the aerodynamic and other properties associated with conventional soccer balls as possible.

Balls which are similar in weight, shape and size to conventional soccer balls but which are softer and have a lower coefficient of elastic restitution would be highly desirable to alleviate the problems discussed above since they would have a flight pattern similar to that of a conventional soccer ball but would not attain as great a velocity as a conventional soccer ball and they would not travel as far. Accordingly, a smaller area could be used to play the game. Similarly, when such a ball strikes a fragile article, such as a window, it will be less likely to break the article if it is softer than a conventional ball.

There are a number of other reasons why softer soccer balls would be of substantial benefit to the sporting public. First and foremost, they would be better suited for the instruction and development of athletic skills in children and handicapped individuals. For example, a skill that must be substantially perfected by anyone (with the exception of a goalkeeper) who wishes to become proficient at the sport of soccer is the ability to receive a ball kicked or thrown from a teammate at a relatively high velocity and to obtain and maintain control of the ball without touching the ball with the hands or arms. This is a skill known in the game as trapping the ball and it entails positioning one's body in such a way that the ball will strike any part of the body (other than the arms and hands) and rebound in front of the player in such a manner that the ball can be kept within a short distance from the player.

Confidence plays a vital role in the performance by an individual in the sport of soccer and it plays an even greater role in the attainment of athletic skills by children and handicapped individuals. Not only do the balls of this invention enable a beginner to trap the ball with greater success, due to their lower coefficient of elastic restitution, they also allow one to trap the ball with a reduced likelihood of pain or injury. This allows the beginner to develop a variety of techniques for trapping the ball and to develop confidence in his ability.

Another important facet of the game of soccer is the ability to strike the ball with one's forehead. This skill is known as heading and it can be used in a variety of ways, e.g., to shoot the ball at the opponent's goal, to trap the ball, to pass the ball, to advance the ball up the field and to clear the ball from one's own defensive area. Since the ball may be traveling at a considerable velocity and since the forehead is a sensitive part of the body, many people will not strike the ball with their forehead as hard as they can, will close their eyes when they do, or will not even attempt to head the ball, any one of which can greatly detract from the ability to play the game. Thus it is important that these habits either be corrected or prevented and the use of a softer ball would be helpful in eliminating any reluctance to strike the ball with the forehead.

The ball of the present invention is also useful in the development of goalkeeper skills. Confidence is probably more important to a goalkeeper than to to anyone else playing the game of soccer. A goalkeeper's confidence can be increased by using the ball of the present invention because the ball is easier to catch and there is less chance of the goalkeeper being injured by being struck by the ball.

The subject invention is directed, then, to substitute soccer balls useful in alleviating the problems described above and a method for making such balls.

DISCLOSURE OF THE INVENTION

According to the invention, balls which are noticeably softer than the conventional soccer balls they are meant to replace are provided. The balls are durable and have the general appearance, size, shape and performance characteristics of conventional soccer balls (particularly the aerodynamic characteristics). The balls are comprised of a generally spherical center portion or core. The center portion is preferably comprised of a fibrous material, such as a loose cotton batting or a wadded piece or pieces of cloth. The center portion has a generally spherical shape by virtue of its method of formation, e.g., it may be held in a generally spherical shape by a cover sheet material, such as a plastic film or the like. The spherically shaped center portion is covered with yarn, preferably a multistrand yarn. The yarn covered center portion is then covered with tape. Preferably, the tape completely covers the yarn to provide waterproofing characteristics to the ball, thereby reducing the likelihood of the ball becoming waterlogged by the yarn and center portion becoming wet. The ball is then finished by covering the spherically shaped structure with a synthetic cloth cover (preferably by sewing a properly shaped, double-knit polyester cloth cover in place). The balls preferably have a coefficient of elastic restitution (as hereinafter defined) in the range of from about 0.5 to about 0.6, more preferably from about 0.51 to about 0.57, and most preferably about 0.54.

The cover preferably comprises first and second cloth pieces secured to each other along their respective perimeters, the cloth pieces having printed or affixed thereon a pattern simulating the pattern on a conventional soccer ball, i.e., an ordered array of pentagons and hexagons, each pentagon contiguous with five hexagons, with the pentagons preferably being of a different shade or color than the hexagons. The first cloth piece has a border at its perimeter comprising a series of straight lines intersecting at their end points and each forming a side of one of the pentagons or hexagons on the first cloth piece. The first cloth piece is positioned such that it is on top of and slightly overlapping the perimeter of the second cloth piece with the border of the first cloth piece so positioned and arranged relative to the second cloth piece that each of the straight lines of the series making up the border of the first cloth piece matches up with a corresponding side of one of the pentagons or hexagons on the second cloth piece and forms a side of the respective pentagon or hexagon on the second cloth piece.

BEST MODE FOR CARRYING OUT THE INVENTION

The present invention is predicated on the discovery that, by proper selection of materials and the proper manufacturing technique, balls both softer and having a lower coefficient of elastic restitution, but having the general appearance, size, shape and characteristics of conventional soccer balls, can be produced. However, the balls of the subject invention require less space in which to play since the balls do not travel as far when kicked. Additionally, there is less danger to limb and property since the balls have a lower coefficient of elastic restitution, reducing the likelihood of broken windows and injury to individuals struck by the balls.

As used herein, the coefficient of elastic restitution (e) is the relative degree to which a ball vertically rebounds from a hard, flat surface when dropped without spin from a specified height. It is calculated according to the following equation:

$$e = \sqrt{\frac{\text{height of rebound}}{\text{height from which ball was dropped}}}$$

Accordingly, a value of 1.0 would represent an object which bounces to a height equal to that from which it was dropped and a value of 0.0 represents an object which does not bounce at all.

In experiments pertaining to the present invention, balls, for which values of coefficient of elastic restitution were obtained, were dropped from a height of thirty-six inches without spin by an operator while an assistant recorded the height of rebound using a mounted yard stick. Each ball was tested using the forementioned procedure twenty times and the average obtained.

In these experiments, conventional, official size and weight soccer balls, inflated to the preferred or recommended pressure, were found to have a coefficient of elastic restitution in the range of from about 0.64 to about 0.68. The balls of the present invention are preferably constructed so as to have a coefficient of elastic restitution in the range of from about 0.5 to about 0.6, more preferably from about 0.51 to about 0.57 and most preferably about 0.54.

Figure 1:
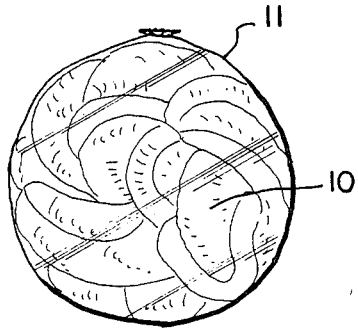
FIG. 1 is a perspective view of the spherical center portion of the ball (core) made by inserting cotton batting into a plastic sheet or bag. This represents the first stage in the preferred embodiment of the ball of this invention.

The method of construction and the makeup of the ball will be better understood by reference to the drawings. In the following description of the ball and its method of manufacture, the most preferred values for the various weights, dimensions, etc., are for a substitute soccer ball generally comparable in size and weight to a conventional number 3 soccer ball. Referring, then, to FIG. 1, a piece or pieces of cloth, such as cotton batting, is formed into a generally spherical shape with a circumference of preferably from about 19.5 to about 21 inches, most preferably about 19 inches, to form the core of the ball. The preferred method of forming the core of the ball is to take about 5 to about 5.5 ounces, more preferably about 5.25 ounces, of cotton batting material 10 and encase the material in a plastic sheet or bag 11 which, when filled, will have a generally spherical shape. The plastic sheet or bag 11, in addition to holding the cloth material in a generally spherical shape, has the advantage of providing additional waterproofing of the core, e.g., when the ball is being used in the rain. While cotton batting is a preferred material, other soft, resilient materials having comparable properties may also be used.

The density of the core is preferably substantially uniform and the center of gravity of the core of the ball is preferably as near the center of the ball as practicable, since a ball having an eccentric center or a core of varying density and/or shape will not bounce as true as a uniform spherical ball, or perform in an acceptable manner when thrown or kicked. For the same reasons, the layers of material surrounding the core are preferably laid down in a uniform manner.

Figure 2:
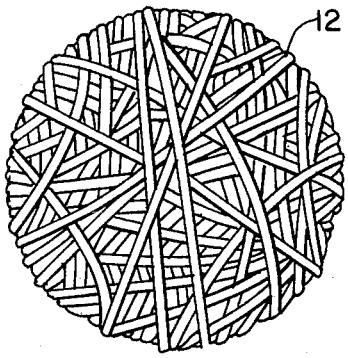
FIG. 2 is a perspective view of the interior of the ball after the center portion has been covered with multistrand yarn.

The generally spherically shaped center portion or core is then wrapped with yarn 12, preferably a coarse, multi-strand synthetic yarn or other similar material at least partially, and preferably completely, covering the core (FIG. 2). A variety of yarns can be used. Particularly preferred is four-ply yarn containing 67 percent acrylic and 33 percent polyester. Preferably, about 400 feet to about 600 feet, more preferably about 500 feet, of a relatively coarse multistrand yarn having a weight of about 0.7 ounces per 100 feet are used. The circumference of the yarn wrapped center portion or core is preferably in the range of from about 19.5 to about 24.5 inches, most preferably about 20.5 inches. The weight of the yarn wrapped core is preferably in the range of from about 8.5 to about 9.5 ounces, most preferably about 8.9 ounces.

Figure 3:
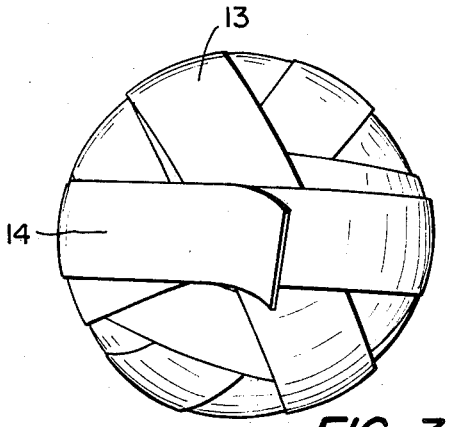
FIG. 3 is a perspective view of the interior of the ball after the yarn layer has been covered with tape.

Referring to FIG. 3, the yarn covered center portion or core is then at least partially covered, and preferably completely covered, with tape 13, more preferably with one continuous piece of cotton tape, preferably adhesive cotton tape, measuring between about 25 feet and about 35 feet, most preferably about 30 feet. After the yarn covered core has been partially or completely covered with cotton tape, an additional strip of cotton tape 14, preferably adhesive cotton tape, is preferably wrapped around the tape wrapped spherical structure in a direction generally perpendicular to the pattern made by the outermost layer of tape. The length of this cotton tape strip is preferably about an inch greater than the circumference of the tape wrapped core sperical structure, i.e., the ends of this tape strip follow a longitudinal path around the ball and the ends overlap by about an inch or so. The circumference of the tape wrapped core is preferably in the range of from about 19 to about 25 inches, most preferably 21 inches. The structure, at this point, preferably has a weight in the range of from about 9.5 to about 10.5 ounces, most preferably about 10 ounces.

The correct size of the structure at this stage may be obtained by either sizing the tape covered structure with a pattern mold or gauge or by measuring its circumference or diameter. For a ball of this invention meant to replace a size 3 regulation youth soccer ball (having a nominal 23 inch circumference), the tape covered intermediate structure, prior to placing it within a cover, should preferably have a circumference of about 21 inches.

The finished ball is then prepared by inserting the tape covered core into a synthetic cloth cover 15 as described below (see also FIG. 7). By synthetic cloth is meant cloth containing greater than 50 percent of a synthetic fiber, such as polyester, nylon, etc. A cotton cover or the like is not desired since it is not as durable, particularly when the ball becomes wet, and the seams tend to split open under the force of being kicked. The cloth cover 15 is preferably of a light weight, e.g., about 6 ounces per square yard. Polyester is the preferred cover material, particularly polyester doubleknit. The use of polyester cloth for the cover, particularly doubleknit polyester cloth, which has been cut to substantially the exact size of the ball and then stretched as it is being secured in place provides a durable, relatively firm ball which maintains its shape well.

The cover preferably comprises first and second cloth pieces 16 and 17 secured to each other along their respective perimeters and each cloth piece having imprinted or affixed thereon a pattern similar to that on conventional soccer balls, i.e., an ordered array of pentagons and hexagons, each pentagon being contiguous with five hexagons. The pentagons and hexagons are preferably colored different shades, e.g., red and white. A trademark or other verbiage may also be imprinted on or affixed to one or both of the cloth pieces.

Figure 6:
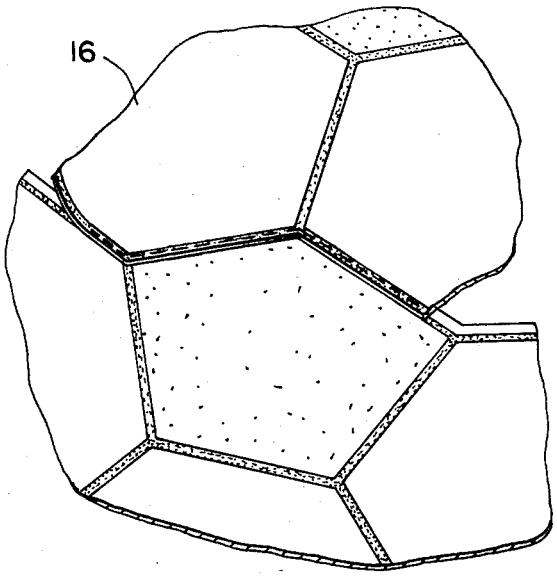
FIG. 6 is a perspective view showing the cloth piece shown in FIG. 5 partially overlapping the cloth piece shown in FIG. 4 and the attachment, by sewing or some other method, of the second cloth piece onto the first cloth piece.
Figure 4:
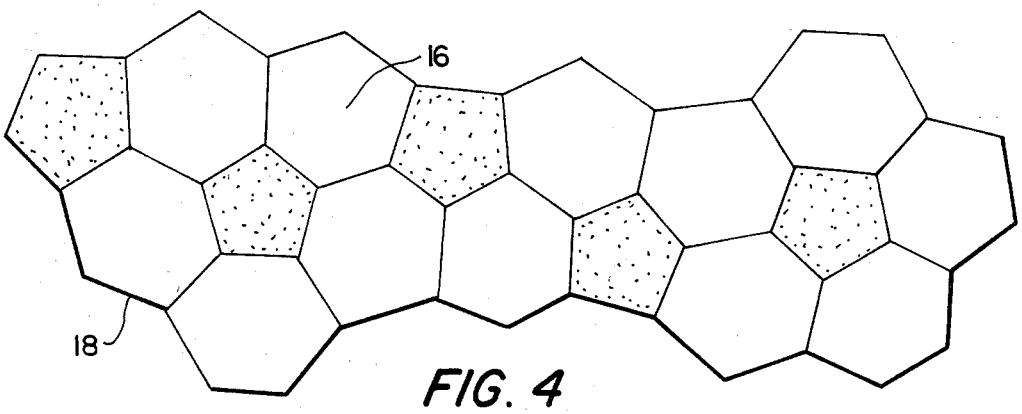
FIG. 4 is a view of one of two cloth pieces used for the cover upon which a pattern has been imprinted or affixed (by, for instance, silk screening).
Figure 5:
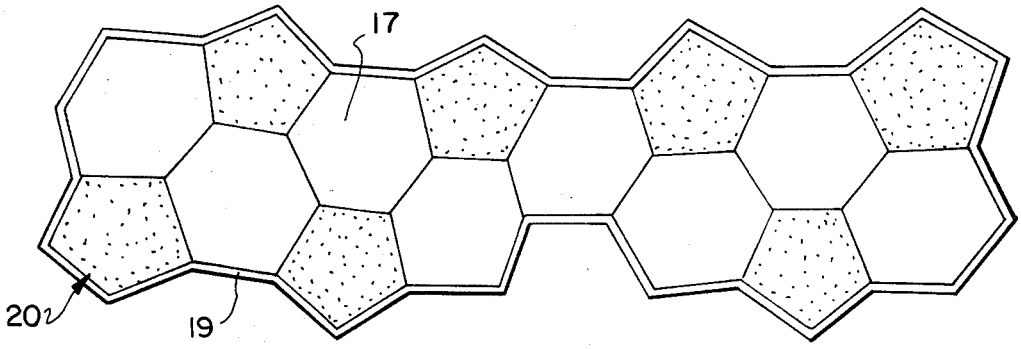
FIG. 5 is a view of the second of the two cloth pieces used for the cover upon which a pattern, substantially similar to that on the first cloth piece, has been imprinted or affixed.

Referring to FIG. 4, the first cloth piece 16 has a border 18 at its perimeter comprising a series of lines intersecting at their end points and each line forming a side of one of the polygons, i.e., one of the pentagons or one of the hexagons. Referring to FIG. 6, the first cloth piece 16 is positioned so that it slightly overlaps the perimeter of the second cloth piece 17 in such a way that each line of the first cloth piece 16 matches up with a line on the second cloth piece 17 and thereby forms a side of one of the corresponding polygons on the second cloth piece. Preferably, the second cloth piece (FIG. 5) has a narrow band of material 19 outside the border 20 made by the series of intersecting lines over which the first cloth piece can overlap and through which the two pieces can be sewn or stitched together or attached in some other manner (as indicated in FIG. 6).

Figure 7:
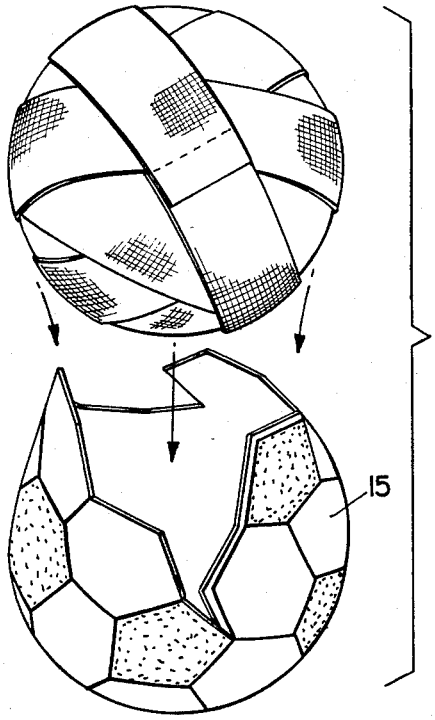
FIG. 7 is a perspective view of the finished interior structure of a ball being placed inside the pocket or cup prepared by partially joining the two cloth pieces (of FIGS. 4 and 5) together along their peripheries.
Figure 8:
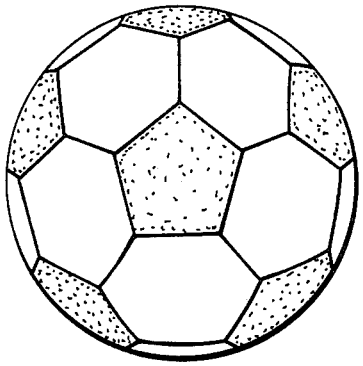
FIG. 8 is a perspective view of the finished ball.

The two cloth pieces 16 and 17 are secured to each other, preferably about half way around their respective perimeters to form an open cup or pocket (FIG. 7). Any suitable thread may be used to sew the cover together but polyester thread is particularly desirable due to its durability. Black thread is preferred but any color thread may be used. The cover could, alternatively, be glued together or attached by other sufficient means of attachment. The tape covered core (FIG. 3) is then inserted into the pocket or cup formed from the partially sewn cover (FIG. 7). The cover is then secured to complete the ball, preferably in the same manner as the pieces were partially connected (FIG. 8). It is also preferable to confine the stitching, to the extent possible, and preferably entirely, to the imprinted or affixed border line so that the closure stitches do not show on the finished ball.

Preferably, the finished ball should weigh from about 10 ounces to about 11 ounces, most preferably about 10.5 ounces. The finished ball should preferably have a circumference from about 19 inches to about 25 inches, more preferably from about 20 to about 23 inches, and most preferably 21 inches.

Various types of soccer balls are in use in the United States. The preferred substitute soccer ball of one embodiment this invention is made to approximate the size and weight of a regulation youth soccer ball, size 3. A regulation youth soccer ball, size 3 has a circumference of about 23 inches and a weight of about 10.5 ounces.

Although the substitute soccer balls of this invention are preferably of about the same size and weight as the regulation size soccer balls they are meant to replace, the substitute soccer balls of this invention have muted characteristics that suit them for use in play, indoors and out. By using a soft solid core, rather than a bladder, the substitute soccer balls have a lower coefficient of elastic restitution than the soccer balls they are meant to replace. The coefficient of elastic restitution of each of the substitute soccer balls is in the range of from about 0.5 to 0.6, more preferably from about 0.51 to about 0.57, and most preferably about 0.54. The corresponding coefficient of elastic restitution of a size 3 regulation youth soccer ball is about 0.66.

It is apparent from the foregoing that the present invention provides new and useful balls and methods for making the same for use in the conventional game of soccer. The present balls can withstand substantial abuse, are washable, are water-resistant, if not totally waterproof, can be used by beginning players where the use of a conventional soccer ball would be potentially dangerous to the players and can be used where space is limited. The balls have a "springy", alive playing feel, leading players using them, particularly beginners, to gain a feeling of confidence in their performance and hence in their own.

It should be understood that various changes and modifications can be made in the details of the procedure without departing from the scope and spirit of the invention. Therefore, it is not intended to be limited except as indicated in the appended claims. For example, by increasing or decreasing the tension with which the yarn is wound about the core, the amount of yarn used, etc, varying degrees of firmness and durability of the ball may be obtained.

INDUSTRIAL APPLICABILITY

The balls of this invention are particularly useful, due to their lower coefficient of elastic restitution and softness, where space is limited, where the players are more susceptible to injury by the use of a conventional soccer ball, e.g., handicapped individuals, and where the surrounding property is susceptible to damage. Since the balls of this invention have approximately the same size, weight and shape of regulation soccer balls, the aerodynamic properties are similar to those of conventional soccer balls and persons who use the balls of this invention can develop skills which may be used in the conventional game of soccer.

I claim:

1. A soccer ball comprising:

(a) a generally spherical center portion or core;

(b) yarn wrapped around said center portion so as to at least partially cover said center portion;

(c) tape at least partially covering said yarn; and (d) a synthetic cloth cover having imprinted or affixed thereon a pattern simulating that on a conventional soccer ball; said ball having the general appearance, weight, size and shape of the conventional regulation soccer ball it is meant to replace but being softer and having a significantly lower coefficient of elastic restitution.

2. The ball of claim 1 wherein said center portion or core comprises a fibrous material.

3. The ball of claim 2 wherein said fibrous material comprises cotton batting material.

4. The ball of claim 3 wherein said cotton batting material is enclosed within a plastic sheet or bag.

5. The ball of claim 1 wherein said yarn is a multistrand synthetic yarn.

6. The ball of claim 1 wherein said tape is a continuous piece of cotton tape.

7. The ball of claim 1 wherein said cloth cover comprises first and second cloth pieces secured to each other along their respective perimeters.

8. The ball of claim 7 wherein said cloth pieces each have imprinted or affixed thereon a pattern simulating the pattern of a conventional soccer ball, said pattern comprising an ordered array of pentagons and hexagons, each of said pentagons contiguous with five of said hexagons, said pentagons being of a different shade or color than said hexagons, said first cloth piece having a border thereon at its perimeter comprising a series of lines intersecting at their end points and each forming a side of one of said pentagons or said hexagons on said first cloth piece and said first cloth piece is positioned such that it is on top of and slightly overlapping the perimeter of said second cloth piece with said border of said first cloth piece so positioned and arranged relative to said second cloth piece that each of said lines of said series making up the border of said first cloth piece matches up with a corresponding side of one of said pentagons or hexagons of said second cloth piece and forms a side of said respective pentagon or hexagon on said second cloth piece.

9. The ball of claim 7 wherein said cover is sewn together with polyester embroidery floss.

10. The ball of claim 1 wherein said center portion of said ball has a circumference in the range of from about 18 to about 21 inches and a weight in the range of from about 5.0 to about 5.5 ounces.

11. The ball of claim 10 wherein said yarn wrapped center portion of said ball has a circumference in the range of from about 18.5 to about 24.5 inches and a weight in the range of from about 8.5 to about 9.5 ounces.

12. The ball of claim 11 wherein said tape wrapped center portion of said ball has a circumference in the range of from about 19 to about 25 inches and a weight in the range of from about 10 to about 11 ounces and a coefficient of elastic restitution of from about 0.5 to about 0.6.

13. The ball of claim 1 wherein said ball has a circumference in the range of from about 19 to about 25 inches, a weight in the range of from about 10 to 11 ounces and a coefficient of elastic restitution in the range of from about 0.5 to about 0.6.

14. The ball of claim 1 wherein said ball is a substitute soccer ball of approximately the same size, weight and shape of a regulation size 3 youth soccer ball.

15. The ball of claim 1 wherein said ball has a circumference in the range of from about 20 to about 23 inches, a weight in the range of from about 10 to about 11 ounces and a coefficient of elastic restitution of from about 0.51 to about 0.57.

16. In a ball having a generally spherically shaped interior structure and a cover, the improvement which comprises:

a cover comprising first and second cloth pieces secured to each other along their respective perimeters, said cloth pieces having imprinted or affixed thereon a pattern simulating the pattern on a conventional soccer ball, said pattern comprising an ordered array of pentagons and hexagons, each of said pentagons contiguous with five of said hexagons, said first cloth piece having a border thereon at its perimeter comprising a series of lines intersecting at their end points and each forming a side of one of said pentagons or said hexagons on said first cloth piece and said first cloth piece is positioned such that it is on top of and slightly overlapping the perimeter of said second cloth piece with said border of said first cloth piece so positioned and arranged relative to said second cloth piece that each of said lines of said series making up the border of said first cloth piece matches up with a corresponding side of one of said pentagons or hexagons on said second cloth piece and forms a side of said respective pentagon or hexagon on said second cloth piece.

17. A method for making a soccer ball comprising:

(a) forming a fibrous material into a generally spherical shape to form the core of said ball;

(b) at least partially covering said core by wrapping yarn about said core while maintaining the spherical shape of the structure;

(c) at least partially covering said yarn covered structure of step (b) with tape while maintaining the spherical shape of the structure to form the interior structure of the ball; and (d) covering said interior structure of step (c) with a synthetic cloth cover having imprinted or affixed thereon a pattern simulating that on a conventional soccer ball.

18. The method of claim 17 wherein said fibrous material of step (a) is enclosed within a plastic bag or sheet prior to being wrapped with yarn to assist in maintaining said fibrous material in said generally spherical shape.

19. The method of claim 17 wherein said cloth cover comprises first and second cloth pieces secured to each other along their respective perimeters, said cloth pieces having imprinted or affixed thereon a pattern simulating the pattern on a conventional soccer ball, said pattern comprising an ordered array of pentagons and hexagons, each of said pentagons contiguous with five of said hexagons, said pentagons being of a different shade or color than said hexagons, said first cloth piece having a border thereon at its perimeter comprising a series of lines intersecting at their end points and each forming a side of one of said pentagons or said hexagons on said first cloth piece and said first cloth piece is positions such that it is on top of and slightly overlapping the perimeter of said second cloth piece with said border of said first cloth piece so positioned and arranged relative to said second cloth piece that each of said lines of said series making up the border of said first cloth piece matches up with a corresponding side of one of said pentagons or hexagons on said second cloth piece and forms a side of said respective pentagon or hexagon on said second cloth piece.

* * * * *